United States Patent [19]

Asick

[11] 4,027,368

[45] June 7, 1977

[54] FORCEPS TOOL FOR WIRE INSERTION

[75] Inventor: John Carl Asick, Harrisburg, Pa.

[73] Assignee: AMP Incorporated, Harrisburg, Pa.

[22] Filed: June 22, 1976

[21] Appl. No.: 698,670

[52] U.S. Cl. ..... 29/751; 29/749; 81/419; 81/425 A

[51] Int. Cl.[2] ..... H01R 43/04

[58] Field of Search ... 29/203 H, 203 HT, 203 HC, 29/203 HM, 203 B, 203 MW; 81/419, 425 R, 425 A

[56] References Cited

UNITED STATES PATENTS 3,604,092 9/1971 Knickerbocker ..... 29/203 HC

*Primary Examiner*—Carl E. Hall
*Attorney, Agent, or Firm*—Gerald K. Kita

[57] ABSTRACT

The disclosure relates to a forceps type hand tool for gripping individual wires, either discrete or in a cable array, and forcibly inserting the gripped wire within a slotted plate type electrical contact. The working portion of the tool laterally supports the contact preventing its collapse or deformation and is machined specially to provide for ease of entry into the clearances around the contact. The tool further is provided with a clearance for a curviform or bowed portion of the wire formed by insertion of the same into the contact.

4 Claims, 9 Drawing Figures

1
10
12
14
16
18
20
22
4
52
54

1
10
48
12
42
46
48
26
30
50
24
34
32
52
34
24
50
54
36
26
36
24
40
44
34
30
32
10
42
12
34
24
50

FORCEPS TOOL FOR WIRE INSERTION

FIELD OF THE INVENTION

The present invention relates to a hand tool for inserting insulation covered wires into slotted plate type electrical contacts, and more particularly, to a hand tool for gripping small cross-section wires, either of discrete form or grouped in a multiple conductor cable array and inserting such wires individually within miniature slotted plate type contacts which are compactly spaced so as to occupy as small a space as possible, for example, within the confines of a miniature electrical connector.

BACKGROUND OF THE PRIOR ART

Many practical considerations impose a need for discretionary interconnections among solid state miniature electrical circuits. Such discretionary wiring has taken the form of individual insulation covered conductors or wires of small cross-section deployed individually or in a group either woven together in a cable array or located side-by-side in a flat ribbon of wires. Slotted plate type electrical contacts have proven to be an effective technique for making electrical connections to the wires, since the contacts can be made miniature in size and closely spaced to occupy a minimum volume. Due to this small size such contacts are delicate and are readily bent or damaged when the wires are forcibly inserted. The absence of adequate clearance spaces around the miniature contacts and the presence of conductors already terminated or connected to certain ones of the contacts make insertion of each succeeding wire impossible to perform by hand and therefore requires an inventive technique for inserting wires into the contacts.

BRIEF DESCRIPTION OF THE INVENTION

The present invention relates to a hand tool of the forceps type which has offset jaws of miniature size for gripping an individual wire and inserting it within a miniature slotted plate contact, while at the same time providing adequate clearances for avoiding damage to adjacent contacts and for clearing wires already terminated or connected to contacts of the contact array. The offset jaws allow for visual inspection during insertion of a wire and means are provided on the jaws for supporting the contact and preventing damage thereto when the wire is forcibly inserted therein. Another feature of the tool according to the present invention resides in the means by which a curviform deformation of the inserted wire is allowed to occur when forcibly inserted into a selected contact.

OBJECTS

It is accordingly an object of the present invention to provide a forceps type tool for gripping an individual wire of small cross-section and for inserting the same within a slotted plate contact of miniature size while allowing for curviform deformation of the wire when inserted into the contact.

Another object of the present invention is to provide a forceps type tool for gripping a wire of small cross-section and inserting the same into a slotted plate type electrical contact of miniature size, the tool being provided with adequate clearances which allow insertion of the tool within the confines afforded by compactly spaced contacts and by the presence of wires already connected to certain ones of the contacts.

Other objects and many attendant advantages of the present invention will become apparent upon perusal of the following detailed description taken in conjunction with the drawings.

DETAILED DESCRIPTION OF THE INVENTION

Figure 6:
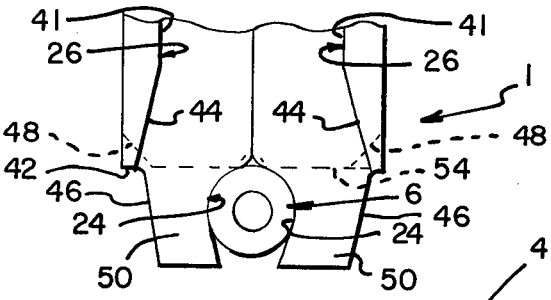
FIG. 6 is an enlarged fragmentary elevation of slotted plate electrical contacts arranged in two rows together with wires already connected to certain ones of the contacts and with another wire gripped by the jaws prior to insertion of the wire into a contact in a foreground row.

With more particular reference to the drawings the tool according to the present invention will be described with reference to insertion of wires into densely spaced, slotted plate type electrical contacts arranged in parallel rows, such as can be found in an electrical connector shown in U.S. Pat. No. 3,820,055. As shown in FIG. 6 of the drawings the contacts 2 of one row are in a foreground row such that their wire receiving and insulation slicing slots are offset laterally from those of similar contacts 4 of a background row. The tool 1 of the present invention grips discrete wires, one of which is shown at 6 and inserts each of them one at a time into a selected slotted plate contact without damaging either of the wire, the contact receiving the inserted wire or an adjacent contact 2 or 4 or other wires shown generally at 8 already connected to certain ones of the contacts. Insertion of the wire 6 into one of the contacts, for example the contact 2, is difficult because the small size of the contacts make them fragile and subject to damage either by the tool or by the force necessary to insert the wire. Also the close spacing of adjacent contacts and the presence of wires 8 already connected to such contacts make it difficult to position the tool in the clearance spaces around the contact 2 which is to receive the wire 6.

As shown more particularly in FIGS. 1–5, the tool 1 includes a pair of elongate resilient leaf spring arms 10, the free ends of which diverge and are provided with corresponding jaws 12 thereon. The opposite ends of the arms 10 are joined with rivets 14. An elongated rivet 16 spans between the arms adjacent their free ends. The tenon portion 18 of the rivet freely passes through aligned apertures 20 in the respective arms 10. The arms are freely slidable along the tenon 18 when biased resiliently toward and away from each other. The tenon further aligns the free ends of the arms 10 and also aligns the jaws 12. The enlarged heads 22 of the rivet limit the amount of outward separation between the arms 10.

Figures 1, 2, 3, 4:
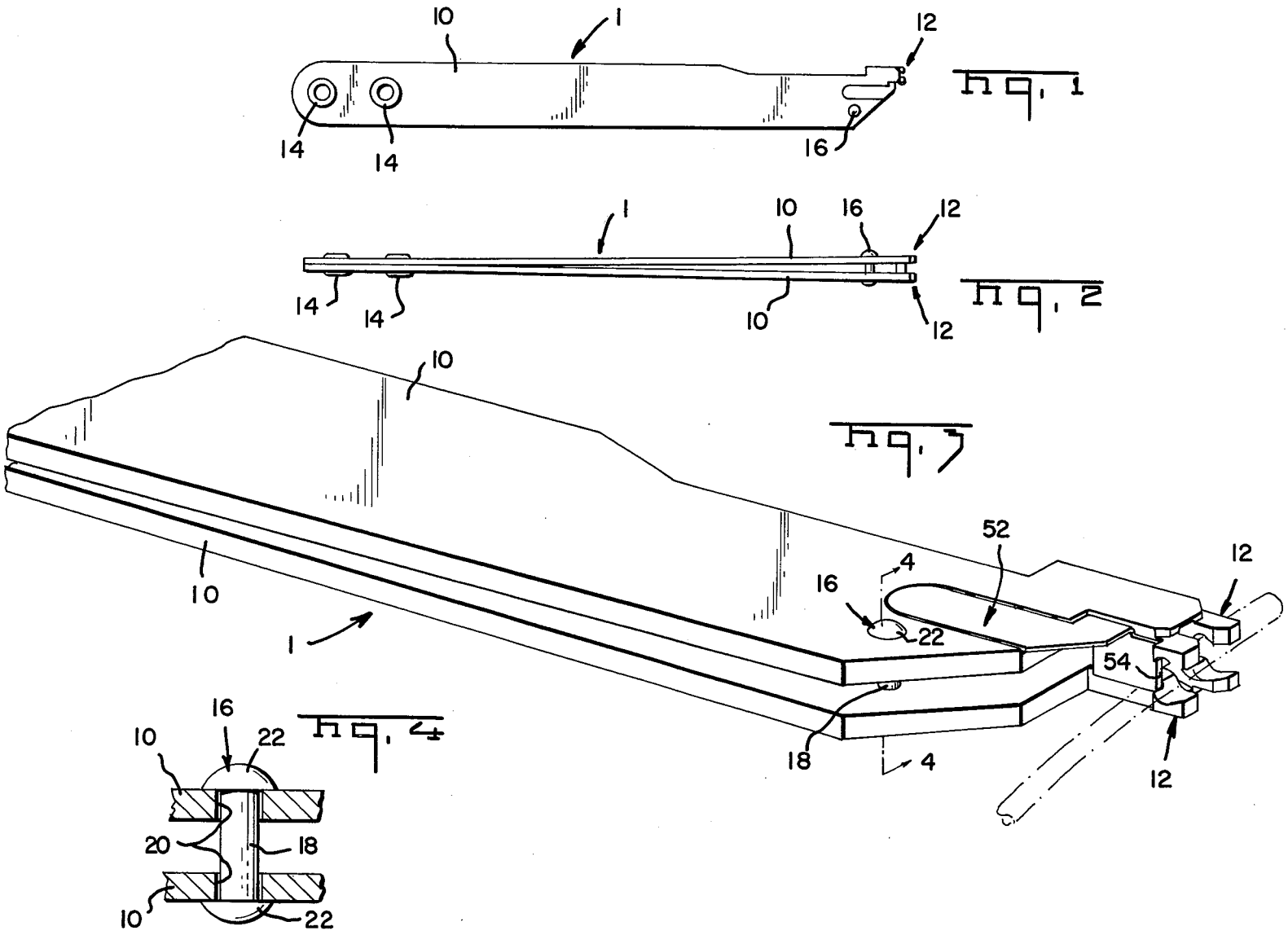
FIG. 1 is a side elevation of a tool according to the present invention.
FIG. 2 is a top plan of the tool shown in FIG. 1.
FIG. 3 is an enlarged fragmentary perspective of the working portion of the tool more particularly illustrating the jaws thereof.
FIG. 4 is an enlarged fragmentary section taken along the line 4—4 of FIG. 3.
Figure 5:
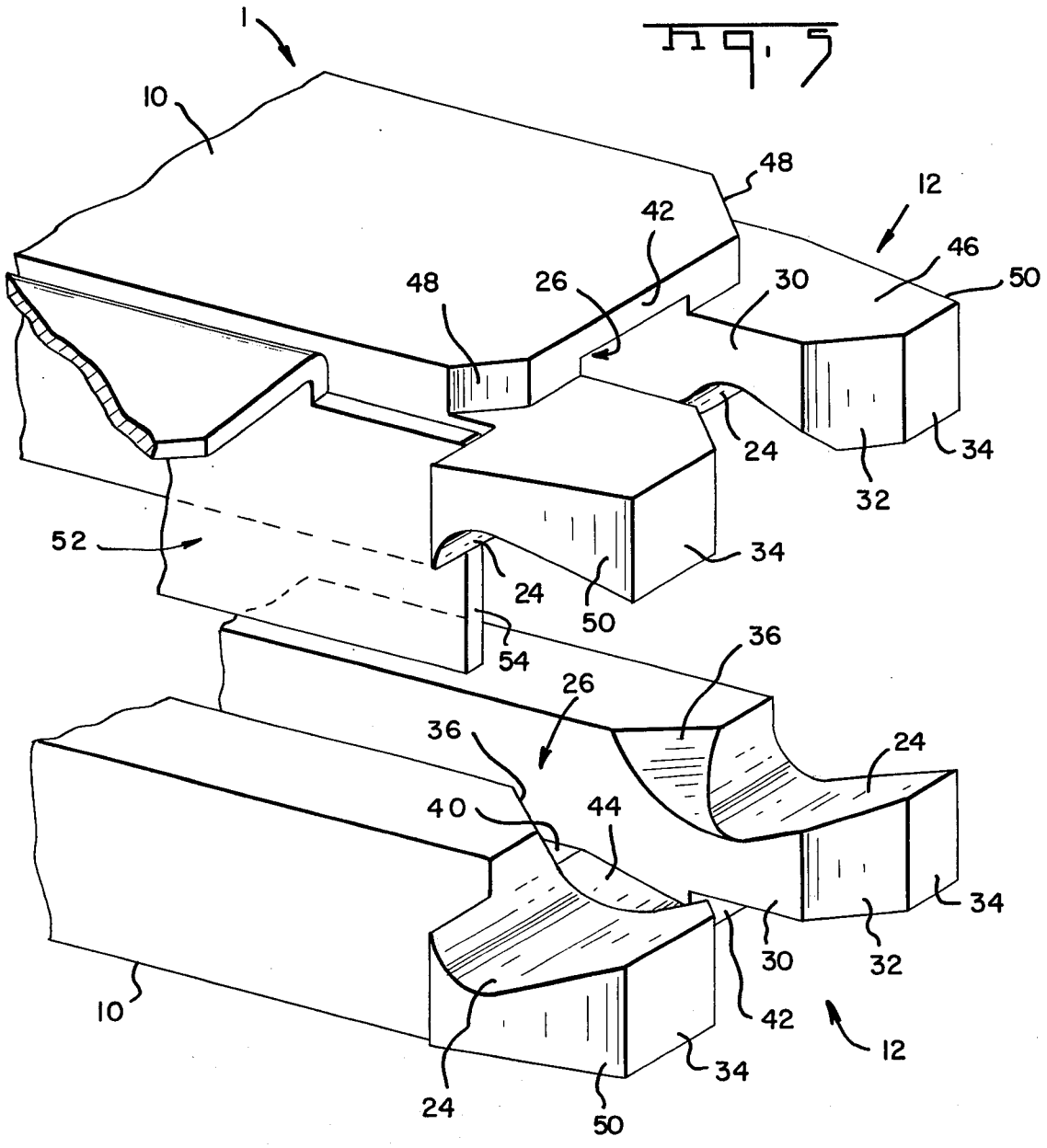
FIG. 5 is a greatly enlarged fragmentary perspective of the jaws comprising the working portion of the tool with parts broken away to illustrate the details thereof.
Figure 7:
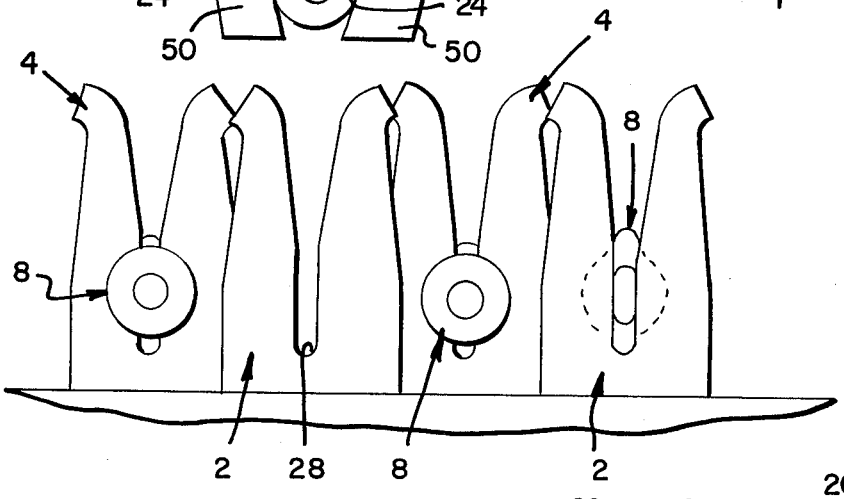
FIG. 7 is an enlarged fragmentary elevation similar to FIG. 6 illustrating insertion of the tool jaws into the clearances afforded by the compactly spaced terminals and wires during insertion of a wire gripped by the jaws into a slotted plate contact in the foreground row.
Figure 7:
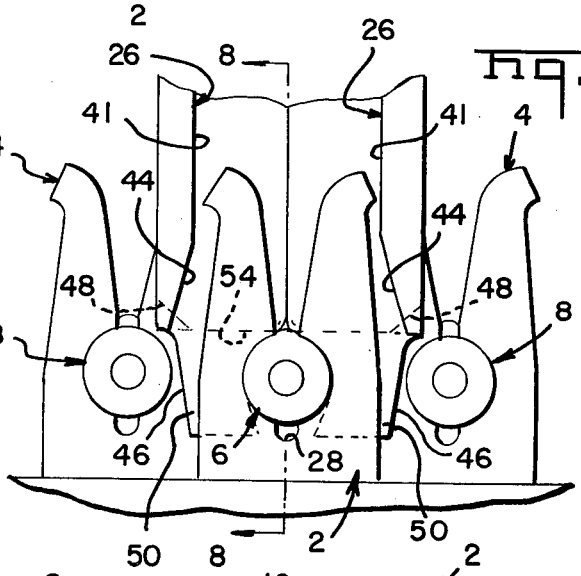

With more particular reference to FIG. 5, each jaw 12 includes an inside surface 24 which grippingly receives a wire placed lengthwise along the inside surface of the jaws generally perpendicular to the elongated spring arms. The inside surfaces 24 of the jaws are provided with wire-receiving curviform recesses to advantageously grip the wire particularly if it is an insulation covered wire of arcuate cross-section. Each jaw is bifurcated by a relatively deeply recessed channel 26. As shown in FIGS. 5 and 7 the channels 26 are mutually aligned lengthwise of the spring arms 10. The open ends of the channels receive a slotted plate contact 2 of the foreground row of terminals illustrated in FIG. 7 allowing full insertion of the jaws and portions of the spring arms in encirclement around the contact 2 when an exemplary wire 6 gripped between the wire-receiving surfaces 24 is inserted into the wire-receiving slot 28 of the contact. The sidewalls 30 of each channel 26 are provided with a flared entryway portion 32 located at the open end of each channel 26, and at the intersection of the sidewalls 30 and an endwall 34 of each jaw. Thus as shown in FIG. 8 the flared entryway portions 32 facilitate funneling the electrical contact 2 into the relatively narrow channels 26.

Figure 8:
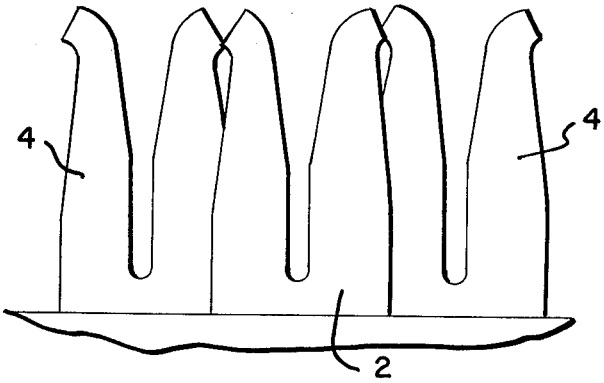
FIG. 8 is a section taken along the lines 8—8 of FIG. 7.
Figure 8:
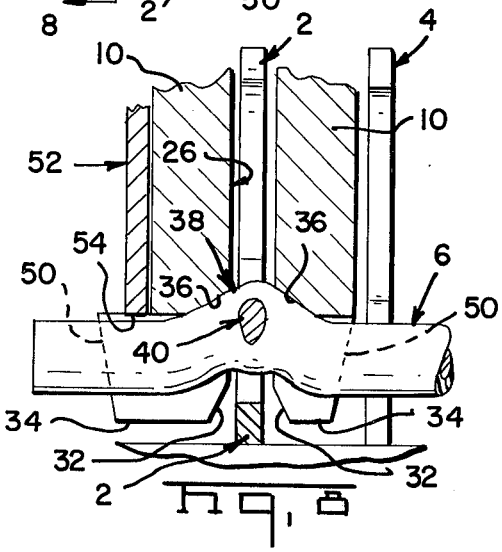

Yet with reference to FIG. 8 taken in conjunction with FIG. 5, the sidewalls 30 of the channel at the intersection with the corresponding wire-receiving surfaces 24 are provided with arcuate dished chamfers 36 which provide a clearance for an arcuate or curviform portion of the wire (shown in FIG. 8) which is formed when the wire 6 is forced into the slot 28 of the slotted plate type contact 2. The curviform chamfers 36 thus allow for deformation of the wire 6 into its curviform configuration 38 which is caused by deformation of the wire into a generally oval cross-section at 40 as the wire is forced into the slot 28. Thus as shown in FIG. 8 the curviform portion 38 of the wire extends partially into each of the aligned channels 26.

As shown more particularly in FIGS. 5 and 7, a bottom wall 41 of each channel 26 terminates at 42 short of the endwalls 34 of the jaws. A pronounced chamfer 44 is provided adjacent each endwall 42. As shown in FIG. 7 the chamfers 44 are opposite one another and provide a funneled entryway or lead-in surfaces for guiding the channel portions 26 of the tool in encirclement around the contact 2. The bottom walls 41 receive therebetween opposite edges of the contact 2 on either side of the contact slot serving as stops to prevent outward spreading of the contact. This insures desired insulation slicing of the wire and prevents permanent widened deformation of the contact to facilitate its entry into a corresponding recess of a cover as described in the above referenced U.S. Patent.

As shown in FIGS. 5 and 7 the endwalls 42 which form the ends of the channels 26 also form stepped shoulders across the outside surfaces 46 of the bifurcated jaws 12. The endwall shoulder 42 is accordingly recessed substantially from the endwall 34. The side margins of the endwall shoulder 42 are provided with pronounced chamfers 48 which, as shown in FIG. 7, provide adequate clearance for additional wires or conductors 6 connected to adjacent contacts 4 of the background row of contacts. Accordingly the chamfers 48 allow for substantial insertion of the tool into the confined space defined between the wires 6 connected to the terminals 4. The tool jaws accordingly are freely insertable into the confines defined between such wires 6 and the contacts 2 and 4 in order to forcibly insert a wire within the slot of the terminal 2.

As shown more particularly in FIGS. 5 and 7, the edge surfaces of the jaws, which bridge between the inside wire gripping surfaces 24 and the outside surfaces 46, are tapered as shown at 50 to promote entry of each jaw into the space between adjacent wires 6 which extend on either side of the terminal 2 and which are already connected to the terminals 4.

A generally L-shaped flange 52 is attached by welding to the free end of one of the spring arms and has an edge 54 bridging across the separation between the jaws and serving as a wire stop adjacent to the recesses 24 of the jaws. Thus as the wire 6 is received and gripped by the jaws, the flange stops the wire 6 from escaping out of the recesses 24 during insertion of the wire into the contact 2.

Figure 9:
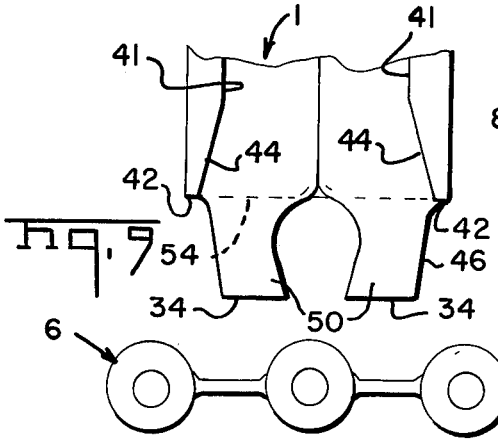
FIG. 9 is an enlarged elevation similar to that of FIG. 6 illustrating use of the tool for inserting a selected conductor of a multi-conductor cable into a selected slotted plate type contact.

FIG. 9 illustrates an alternative use of the tool 1 wherein the end surfaces 34 of the tool serve as anvils to engage and forcibly insert a conductor 6 into a corresponding contact 2. Such use of the tool is particularly advantageous when a plurality of conductors 6 are connected together in a flat ribbon array as shown in FIG. 9 or any other array such as a woven cable. In such instances each discrete conductor 6 need not be gripped by the wire-receiving surfaces 24 but instead can be correctly positioned over a desired contact because of its placement in the array, and all that is required is the application of sufficient force to insert a selected wire into a corresponding slot of a selected contact 2 or 4. However, entry of the tool jaws into the clearances defined by adjacent contacts and wires already terminated to such contacts is required, as described above with respect to FIG. 7. Also the chamfers 32 will allow for deformation of an inserted conductor 6 into its curviform portion 38.

Although a preferred embodiment of the present invention has been described and illustrated in detail other modifications and embodiments which would be obvious to one having ordinary skill in the art are intended to be covered by the spirit and scope of the appended claims.

What is claimed is:

1. A forceps insertion tool, comprising:

a pair of leaf spring arms connected together at respective one ends and diverging toward respective free ends which are provided thereon with wire gripping jaws, inner surfaces of the jaws having wire gripping surfaces for gripping a wire therebetween, said wire gripping surfaces being bifurcated by corresponding channels which receive therein a slotted plate type electrical contact for connection with a wire gripped between said jaws, said jaws having curviform recesses at the intersection of said said channels with said wire gripping surfaces providing clearances for a curviform portion of said wire resulting from deformation of said wire upon insertion of said wire into said contact.

2. The structure as recited in claim 1, wherein, the outer surfaces of said jaws are recessed for ease in inserting said jaws into clearances around said contact.

3. The structure as recited in claim 2, wherein, surfaces of said jaws which bridge between said inner and said outer surfaces are tapered for ease in inserting said jaws into clearances around said contact.

4. The structure as recited in claim 1, wherein, said channels include bottom walls receiving outer edges of said contact preventing outward deformation of said contact.

* * * * *